US007175232B2

(12) United States Patent
Rivera

(10) Patent No.: US 7,175,232 B2
(45) **Date of Patent: *Feb. 13, 2007**

(54) ROCKING CHAIR

(75) Inventor: Richard Rivera, Garden Grove, CA (US)

(73) Assignee: Tropitone Furniture Co., Inc., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/747,866

(22) Filed: Dec. 29, 2003

(65) Prior Publication Data

US 2004/0164219 A1 Aug. 26, 2004

Related U.S. Application Data

(62) Division of application No. 10/319,343, filed on Dec. 13, 2002, now Pat. No. 6,752,458.

(51) Int. Cl.
*A47C 3/02* (2006.01)

(52) U.S. Cl. ..... 297/258.1; 267/158; 248/628

(58) Field of Classification Search ..... 248/628, 248/596; 267/158, 36.1–52; 297/258.1, 297/344.1, 325, 259.1, 259.4, 302.1, 302.3; D6/344; 472/103

See application file for complete search history.

(56) References Cited

U.S. PATENT DOCUMENTS 2,028,299 A * 1/1936 Swinton ..... 267/50
2,283,755 A 5/1942 Mies
2,302,950 A 11/1942 Parsons
2,313,559 A 3/1943 Larsen et al.
2,450,869 A * 10/1948 Berry ..... 267/47
2,533,511 A * 12/1950 Rowland et al. ..... 267/47
2,689,464 A 9/1954 Wurtz
3,297,360 A 1/1967 Holmstrom
3,337,265 A 8/1967 Benzing
3,452,974 A * 7/1969 Dixon ..... 267/47
3,462,113 A 8/1969 MacLeod
3,740,792 A 6/1973 Werner
4,043,594 A * 8/1977 Cabell ..... 297/353
4,119,343 A 10/1978 Pentzien
4,183,494 A 1/1980 Cleveland
4,340,250 A 7/1982 Ward
4,383,714 A 5/1983 Ishida
4,546,958 A * 10/1985 Ohno et al. ..... 267/47
D290,068 S 6/1987 Vanderminden
D291,846 S 9/1987 Conn
D299,986 S 2/1989 Doughty
D300,090 S 3/1989 Frinier
4,971,394 A 11/1990 Vanderminden
5,039,164 A 8/1991 Gibbs
5,217,198 A 6/1993 Samarov et al.

(Continued)

*Primary Examiner*—Korie Chan
(74) *Attorney, Agent, or Firm*—Knobbe, Martens, Olson & Bear, LLP.

(57) ABSTRACT

A rocking chair comprises a base portion and a seat portion and includes a pair of C-springs for coupling the base portion to the seat portion. The C-springs flex to provide the seat portion with a desirably smooth and soft rocking motion while providing excellent structural integrity. Each C-spring has a contoured cross-sectional profile that provides a spring stiffness adapted to provide a smooth and comfortable rocking motion for a wide variety of body weights. The contoured cross-sectional profile also provides a high torsional resistance for minimizing lateral rocking movement of the seat portion.

8 Claims, 6 Drawing Sheets

U.S. PATENT DOCUMENTS 5,599,064 A 2/1997 Vanderminden, Sr.
5,655,816 A * 8/1997 Magnuson et al. ..... 297/452.2
5,947,562 A * 9/1999 Christofferson et al. ..... 297/440.22
D415,363 S 10/1999 Rehmert et al.

* cited by examiner

ROCKING CHAIR

RELATED APPLICATIONS

The present application is a division of application Ser. No. 10/319,343, filed on Dec. 13, 2002 now U.S. Pat. No. 6,752,458.

BACKGROUND OF THE INVENTION

1. Field of the Invention

This invention relates to chair structures, and more particularly, to an improved chair structure that is well-suited for outdoor use and provides swiveling and rocking motions.

2. Description of the Related Art

Outdoor furniture can be found in a wide variety of locations, such as, for example, outdoor restaurants, patios, and backyards. Outdoor furniture takes a wide variety of different forms but is typically manufactured from plastic and/or metal components to withstand the damaging effects of exposure to sun and moisture.

A common piece of outdoor furniture is the outdoor chair. Most outdoor chairs are constructed as rigid, unitary structures. However, for comfort and convenience, some outdoor chairs have a seat portion that is adapted to swivel relative to a base portion while other chairs provide the user with the ability to rock forward and backward. Still other chairs provide both swiveling and rocking motions.

In order to provide a rocking motion, some chairs include a pair of curved rails mounted beneath a seat portion of the chair. The curved rails contact the ground and are shaped to allow the user to rock back and forth with a smooth and comfortable motion. However, rocking chairs having curved rails are typically quite large and cumbersome and do not cooperate well with a table. Furthermore, curved rails are adapted for use on a relatively flat and smooth surface. The ground in an outdoor environment is often rough and uneven and therefore curved rail rocking chairs are not well-suited for outdoor use. In addition, curved rail rocking chairs are usually constructed of wood, are quite heavy and can be difficult to transport.

Rocking chairs constructed with a base portion that is fixed relative to the ground are better suited for use in an outdoor environment. To provide a rocking motion, a fixed-base chair structure includes a flexible coupling member that is located between the base portion and the seat portion. Fixed-base rocking chairs are typically less bulky than curved rail rocking chairs. As a result, fixed-base rocking chairs are more compact and may be used with a table in a more practical fashion. In addition, they do not require a smooth, flat surface.

A flexible coupling member used with a fixed-based rocking chair may take a variety of different forms. However, in each case, the flexible coupling member allows movement of the seat portion relative to the base portion. Flexible coupling members of this type are typically constructed of a steel alloy. Over the years, steel has been a preferred material for flexible coupling members because steel provides a desirably smooth and soft rocking motion while, at the same time, providing sufficient strength to accommodate a wide variety of body weights. In addition, a flexible steel structure can be subjected to a very large number of working cycles with minimal changes in stiffness or brittleness.

Although steel has many desirable qualities for use as a flexible coupling member, steel has numerous shortcomings that limit its desirability and usefulness for certain applications. For example, steel is susceptible to rust and corrosion when exposed to moisture. Rust and corrosion can substantially decrease the aesthetic appeal of the chair and can also diminish the structural integrity of the chair. In another shortcoming, steel has a relatively high density and is therefore heavy and cumbersome as compared with many other materials. As a result, a chair having steel components can be quite difficult to move. In yet another shortcoming, steel has a relatively high heat capacity and can therefore become uncomfortably hot when exposed to direct sunlight.

Due to these and other shortcomings associated with the use of steel, aluminum has become an increasingly popular material for use in outdoor furniture components. Aluminum is lightweight, rust-resistant, and is better suited for use in direct sunlight. However, in the past, attempts to manufacture flexible components from aluminum have not been successful because aluminum does not have the same desirable flexibility and strength of steel. In particular, a flexible coupling member made of aluminum has not been capable of providing the desirable qualities of a steel spring while providing sufficient structural integrity to ensure safe use. Accordingly, attempts to manufacture rocking chairs using flexible coupling members made from aluminum or aluminum alloys have not been met with widespread success.

Thus, there exists a need for a fixed-base chair structure formed, at least in part, from lightweight, rust resistant, aluminum components that is capable of providing a desirably smooth and soft rocking movement. It is desirable that such a chair structure be capable of providing a swivel motion. It is also desirable that such a chair structure include a flexible coupling member that is capable of providing the strength and durability to be used with a wide variety of body weights over a very large number of rocking cycles. Furthermore, such a chair should be configured to minimize undesirable lateral rocking motions. To be practical, such a chair must be easy to transport and inexpensive to manufacture. The present invention addresses these needs.

SUMMARY OF THE INVENTION

The present invention provides a new and improved, rugged, lightweight, outdoor rocking chair that provides a desirably comfortable rocking motion using an improved spring mechanism that is preferably formed from aluminum alloy. The spring mechanism includes at least one C-shaped member (i.e., "C-spring") that provides a flexible coupling member between a fixed base portion and a seat portion. The C-spring is manufactured with a contoured profile that provides desirable strength and flexibility.

In one aspect of the invention, the chair includes at least one C-spring that is strong, lightweight and has a relatively thin profile. The C-spring is preferably formed from an aluminum alloy and therefore will not rust when exposed to sunlight and moisture. In a significant feature of the invention, the C-spring is formed with a contoured profile of variable thickness. The C-spring is preferably contoured to provide a cross-sectional profile having a thin middle portion and thicker side portions. As a result of the contoured profile, the C-spring has excellent structural integrity while providing high torsional stiffness to reduce undesirable lateral movements of the seat portion relative to the base portion. Such a contoured C-spring also provides a lightweight, rugged construction that is capable of withstanding a wide variety of body weights over a large number of working cycles.

In a preferred embodiment, the chair has two aluminum C-springs that are mounted in a spaced-apart configuration.

The C-springs are constructed to provide a spring constant that allows the seat portion to be rocked in a forward and backward motion over a desirable range of motion. At the same time, the spacing of the C-springs creates a very stable structure that resists undesirable lateral rocking movement.

In another aspect of the invention, the rocking chair of the present invention is characterized by a seat portion, a fixed base and a pair of spaced-apart aluminum C-springs which flexibly couple the seat portion to the base portion. The C-springs are mounted at opposite ends of a horizontal support. To provide a swivel motion, a vertical post extends downward from the horizontal support. The bottom end portion of the post is received by a center hole in a fixed base. The post is capable of rotating within the hole to provide the swivel motion. The fixed base is configured for contacting the ground to provide a stable support. The fixed base may take a variety of different forms, including, but not limited to, three legs, four legs, or a circular member.

Other features and advantages of the invention will become apparent from the following detailed description, taken in conjunction with the accompanying drawings, which illustrate, by way of example, the features of the invention.

DETAILED DESCRIPTION OF THE PREFERRED EMBODIMENTS

Due to changing weather conditions and the like, outdoor furniture is frequently transported from place to place. Therefore, it is desirable that an outdoor chair be constructed from durable, lightweight materials. Furthermore, to be comfortable and convenient, it is desirable that an outdoor chair provides a comfortable rocking motion. In addition, it is desirable that an outdoor chair possesses sufficient structural integrity such that it can withstand a rocking motion over a large number of working cycles without deforming or breaking. Finally, it is desirable that an outdoor chair be constructed from a material that will not rust due to exposure to sunlight or moisture.

Figure 1:
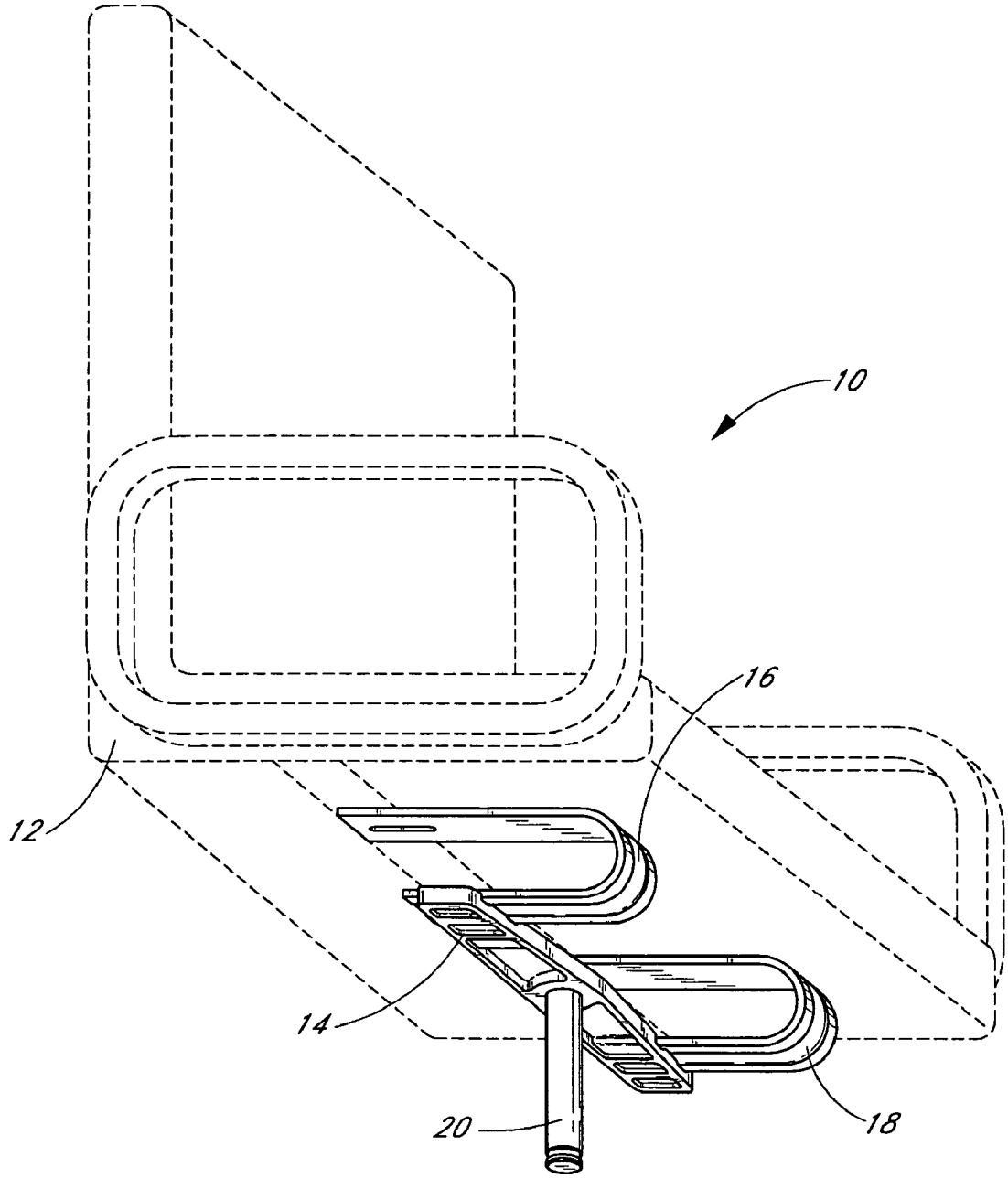
FIG. 1 is a perspective view of a preferred embodiment of a chair structure having a flexible coupling member comprising two spaced-apart C-springs mounted along a horizontal support.

Referring now to FIG. 1, for purposes of illustration, a preferred embodiment of the present invention is embodied in a portable outdoor rocking chair 10 including, generally, a seat portion 12, a horizontal support 14 and two C-springs 16, 18. Each of the C-springs has an open end and a closed end and is manufactured to have a desired stiffness for providing the chair with a smooth rocking motion over a comfortable range of motion. The C-springs are adapted to provide a rugged construction and may be subjected to a large number of bending cycles while maintaining a constant stiffness. By utilizing two spaced-apart C-springs, the chair provides a large resistance against undesirable lateral movement. The C-springs are preferably formed from an aluminum alloy, such as 6061-T4. Alternatively, the C-springs may be formed from other aluminum alloys, or from other suitably strong, yet lightweight materials.

Still referring to FIG. 1, in order to provide a swivel motion, a cylindrical post 20 extends from the bottom of the horizontal support 14 and projects vertically downward. In a significant feature of the present invention, the horizontal support 14 and the post 20 are die cast as a single unit for improved strength and ease of manufacture. The horizontal support and post are preferably made of an aluminum alloy, such as, for example 6063-T5. As illustrated in FIG. 1, the bottom surface of the horizontal support 14 is preferably milled to reduce weight while still leaving sufficient material to maintain excellent strength. The horizontal support 14 is preferably about 12–16 inches in length, and most preferably is about 13.8 inches in length. The horizontal support is preferably about 2.0–3.5 inches in width, and most preferably is about 2.6 inches in width. The horizontal support may be straight or shaped along its longitudinal axis as desired according to the particular need.

Figure 2:
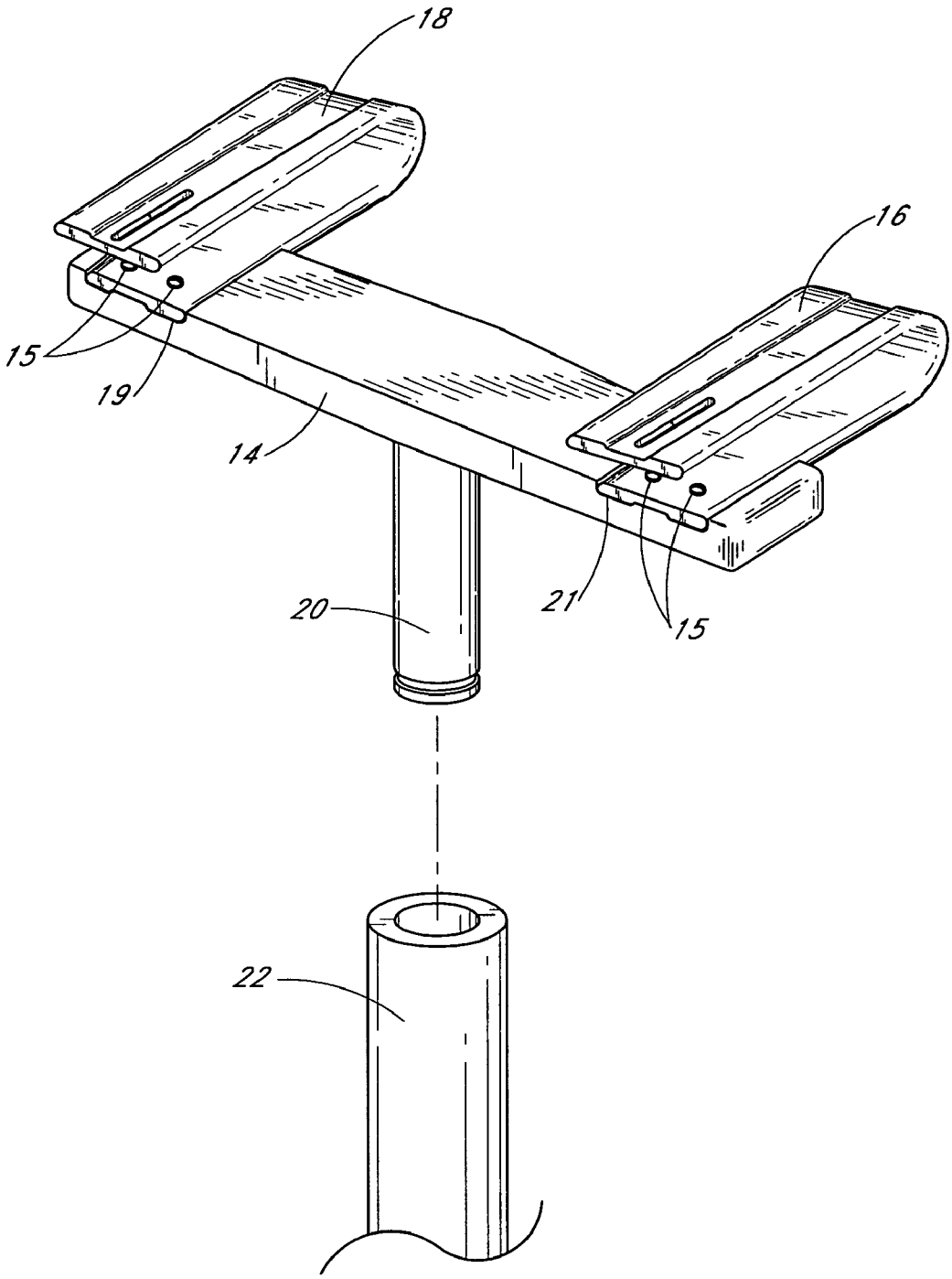
FIG. 2 is an enlarged perspective view of the flexible coupling member of FIG. 1 and further illustrating assembly of the post into a hole formed in the fixed-base of the chair structure.

Referring now to FIG. 2, each of the C-springs 16, 18 is preferably attached to the top surface of the horizontal support 14 by a plurality of bolts 15. However, the C-springs may be attached by other means, such as by welding or brazing, without departing form the scope of the invention. A hollow member 22 is provided in the fixed-base portion of the chair and provides a cylindrical cavity for receiving the bottom end portion of the post 20 in a telescopic fashion. The post 20 is rotatable within the hollow member 22 to allow the seat portion 12 to swivel relative to the fixed-base portion (not shown). Alternatively, a cylindrical cavity may be integrated into the horizontal support and a post may be attached to the fixed-base without departing from the scope of the invention.

As illustrated in FIG. 2, the top surface of the horizontal support 14 preferably includes recesses 19, 21 at the left and right ends wherein the recesses are shaped to receive the contoured surfaces of the C-springs 16, 18. The recesses 19, 21 allow for improved mating of the components and provide enhanced mounting stability and structural integrity. The C-springs are preferably mounted at or near the left and right ends of the horizontal support for maximum lateral support. In a preferred construction, the centerlines of the C-springs are spaced approximately 10 inches apart.

Figure 3:
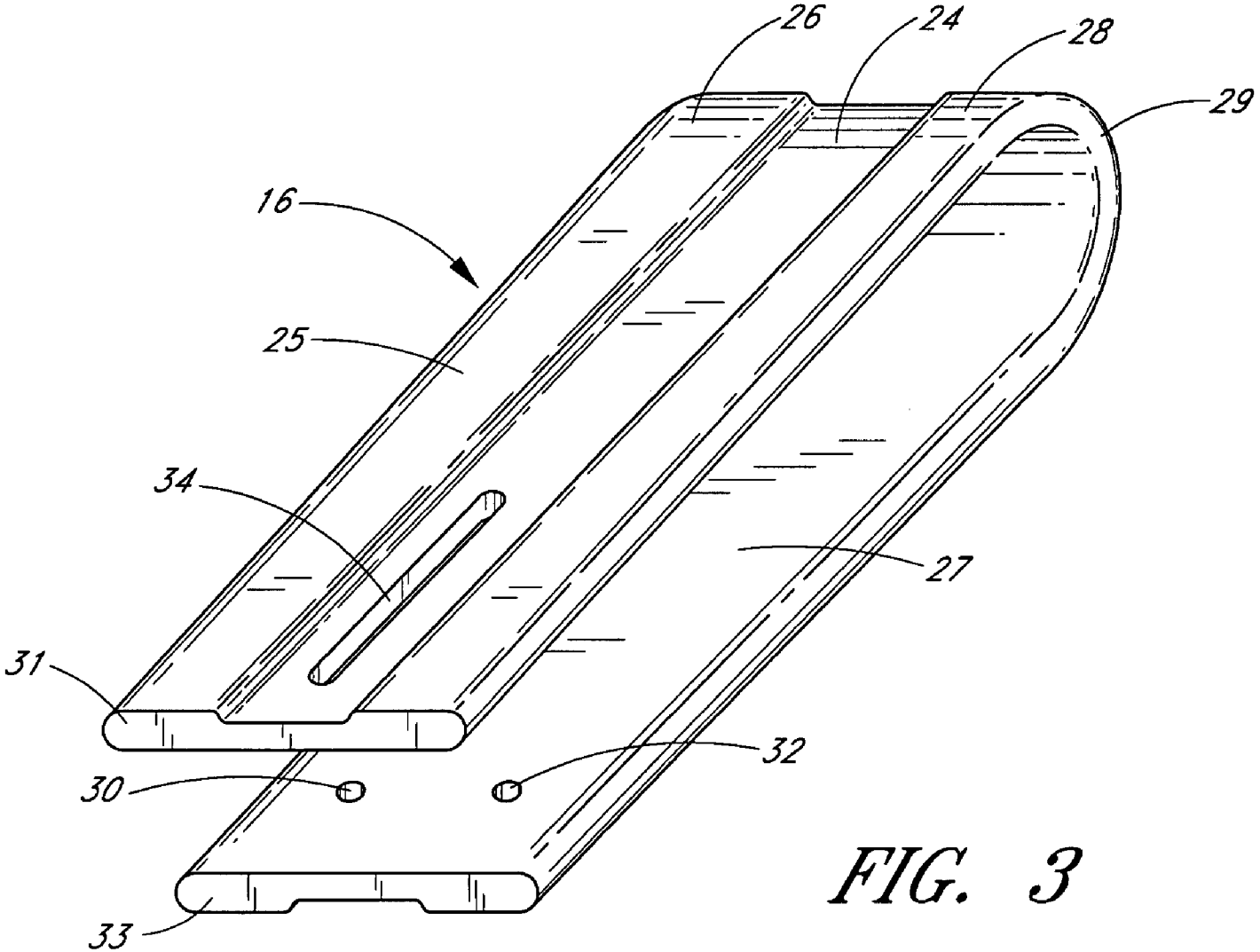
FIG. 3 is an enlarged perspective view of a single C-spring illustrating the contoured profile and mounting features.

FIG. 3 illustrates an enlarged view of an individual C-spring 16 according to a preferred embodiment of the present invention. The C-spring 16 is a substantially elongate member having a first end 31 and a second end 33. The elongate member is folded over to provide a top segment 25, a bottom segment 27 and a curved segment 29.

In an important feature of the preferred embodiments, the C-spring 16 is manufactured with a relatively thin center portion 24 as compared with the thicker side portions 26, 28, thereby providing a contoured, variable thickness, cross-sectional profile. To provide the thin center portion 24, a channel extends along the outer surface of the C-spring, preferably along the entire length from the first end to the second end. The variable thickness profile advantageously reduces the weight of the spring while achieving excellent strength and flexibility. Furthermore, the unique profile advantageously allows the C-spring to provide a smooth and predictable rocking motion over a wide variety of body weights. Unlike previous spring configurations, the contoured C-spring of the present invention is flexible enough such that a relatively lightweight person can rock comfortably, yet has the strength to also accommodate large body weights. Furthermore, the contoured shape of each C-spring provides a high torsional resistance. In an important feature, the high torsional resistance minimizes undesirable lateral movements of the seat portion relative to the base portion and thereby provides the user with a very comfortable and consistent rocking motion.

Each C-spring is preferably provided with at least two circular holes 30, 32 extending through the bottom segment 27 of the C-spring. Bolts or other fasteners are inserted through the holes to enable attachment of the C-spring to the horizontal support. Each C-spring is further provided with a slot 34 extending through the top segment 25 for facilitating attachment to the bottom of the seat portion of the chair. Attachment to the seat portion can be achieved using bolts, welding, or any other fastener or combination of attachment means.

Preferably, each C-spring is about 2.81 inches wide and is about 0.29 inches thick along the side portions 26, 28. The center portion 24 is preferably about 0.20 inches thick and 1.14 inches wide. The C-spring is preferably about 8.5 inches in length from front to back and is about 2.5 inches in height from top to bottom.

Figure 4:
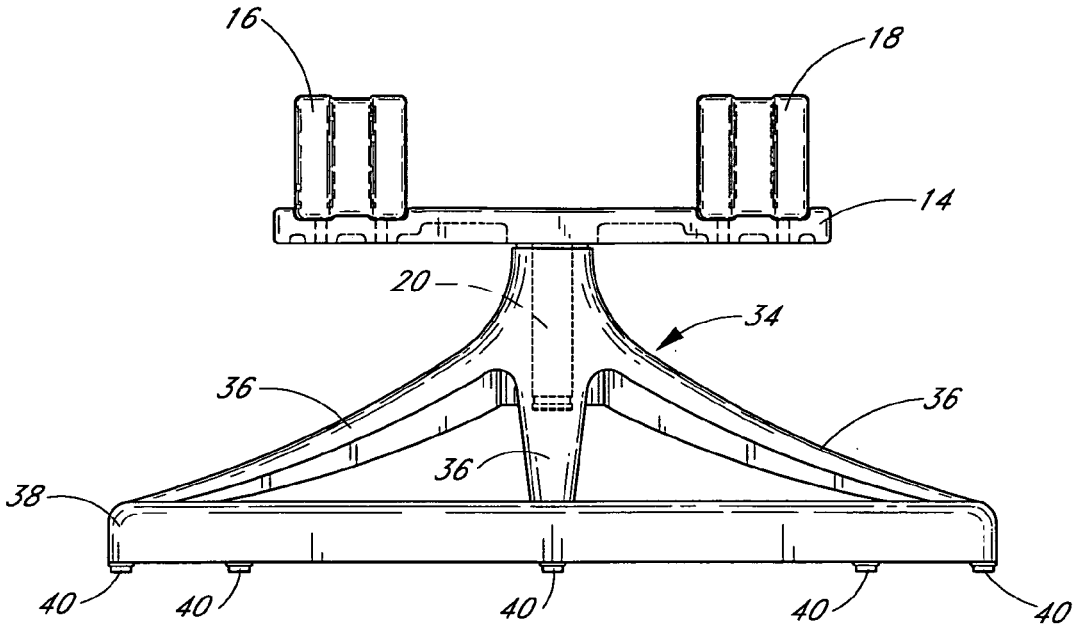
FIG. 4 is a front elevational view of the fixed base portion and the flexible coupling member.

FIG. 4 is a front elevational view of a preferred embodiment showing a fixed-base portion 34 of a chair structure with a flexible coupling member mounted thereon. The post 20 (shown in phantom) is inserted into a cylindrical cavity in the fixed-base portion 34. The fixed-base portion includes a plurality of legs 36 mounted at the bottom end to a circular ring 38. The circular ring 38 is adapted for contact with the ground. A plurality of skid-resistant pads 40 is provided along the bottom surface of the circular ring 38. Although the fixed-base portion is illustrated in a particular form, the fixed-base portion may take a variety of different forms without departing from the scope of the present invention.

Figure 5:
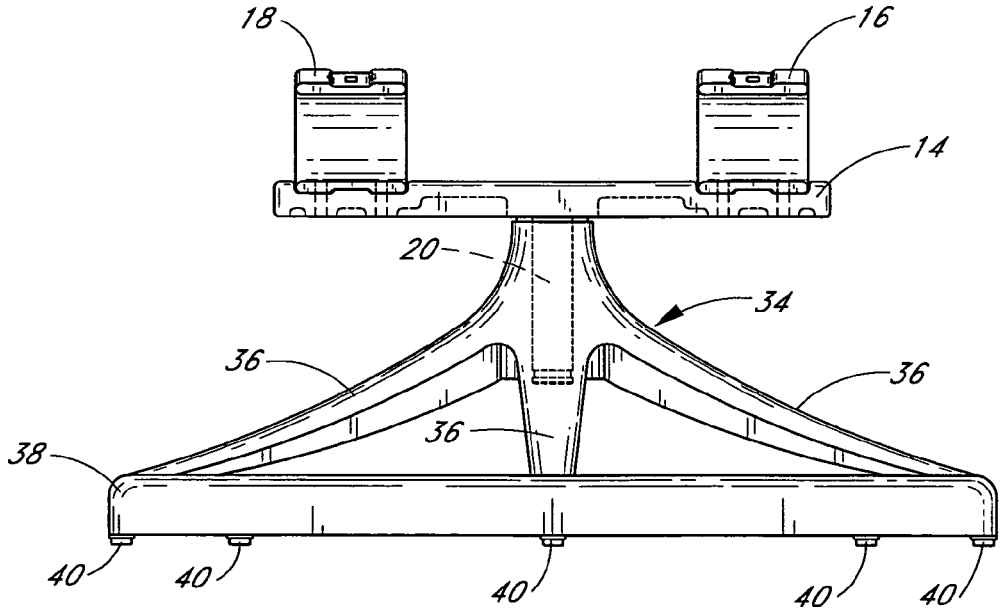
FIG. 5 is a rear elevational view of the structure of FIG. 4.
Figure 6:
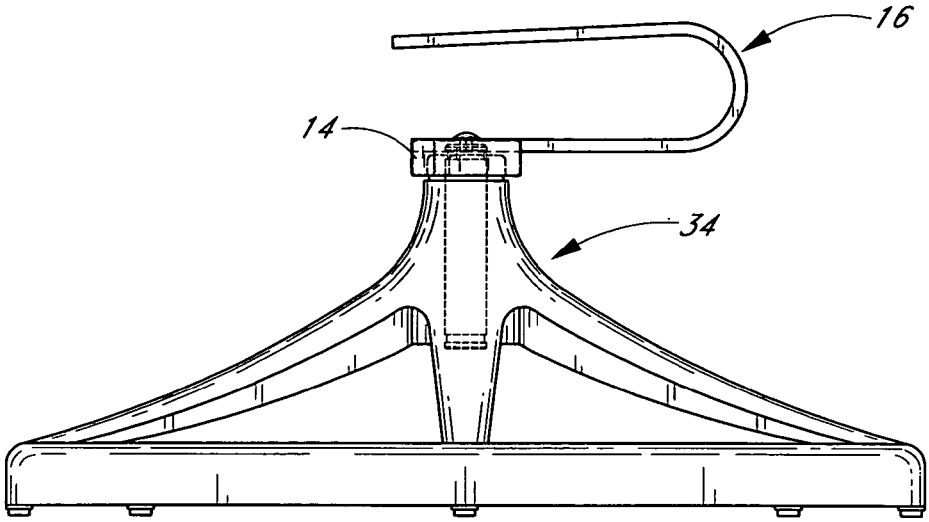
FIG. 6 is a right side elevational view of the structure of FIG. 4.
Figure 7:
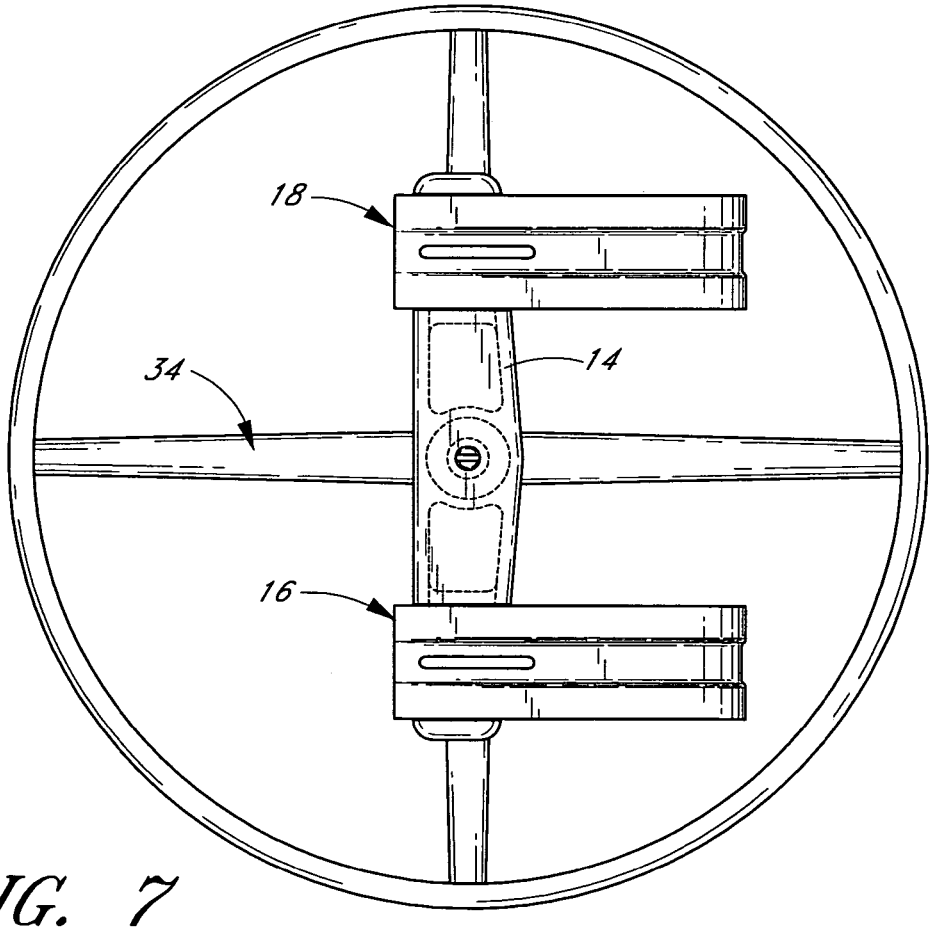
FIG. 7 is a top plan view of the structure of FIG. 4.

As discussed above, the flexible coupling member is constructed to allow the seat portion to swivel or rock back and forth with respect to the fixed-base portion. The flexible coupling member comprises a horizontal support 14 with a vertical post 20 extending downward into the fixed-base structure. The vertical post enters a cylindrical cavity in the fixed-base portion to provide a smooth and easy swivel motion. A pair of spaced-apart C-springs 16, 18 is mounted along the top of the horizontal support 14. A seat portion (not shown) is mounted to the top segments of the C-springs 16, 18. FIGS. 5 through 7 illustrate rear, right side and top views, respectively, of the fixed-base portion having the flexible coupling member of FIG. 4 mounted thereon.

Figure 8:
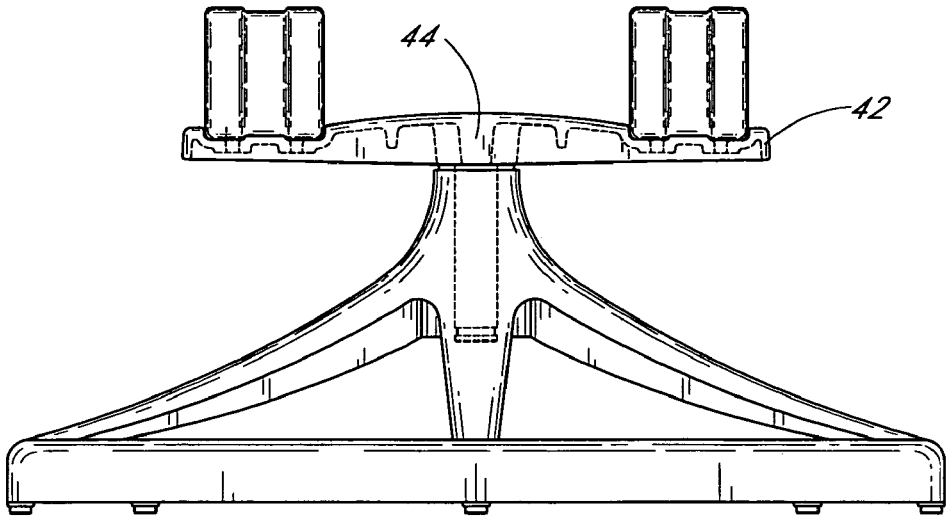
FIG. 8 is a front elevational view of an alternative embodiment of a horizontal support.

FIG. 8 is a front elevational view illustrating an alternative embodiment of a horizontal support 42 having a curved shape that provides a relatively thick center portion 44. FIG. 8 is exemplary of one alternative embodiment of a horizontal support; however, the horizontal support may take a wide variety of different shapes and any support member capable of supporting the C-springs is believed to be within the scope of the present invention.

Figure 9:
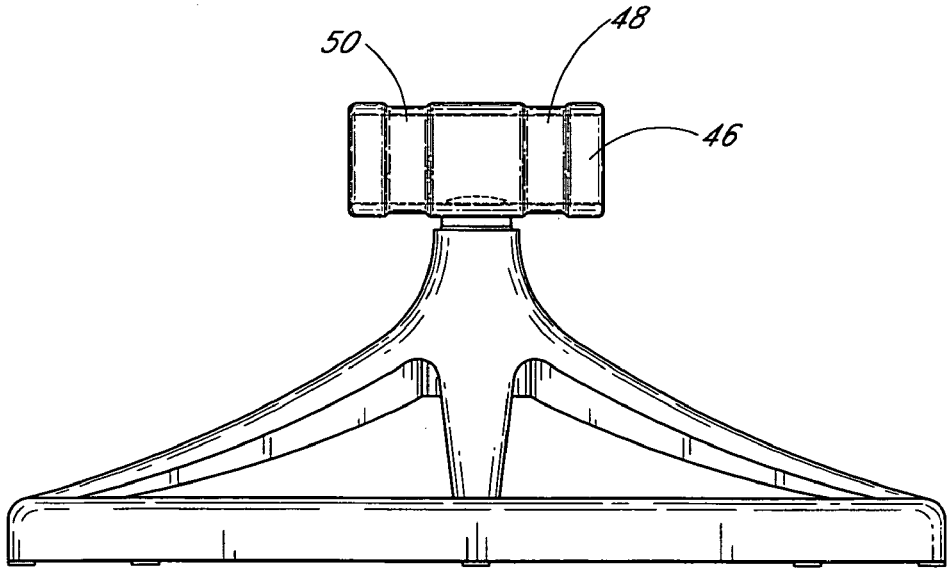
FIG. 9 is a front elevational view of another alternative embodiment of a flexible coupling member having a single contoured C-spring.

FIG. 9 is a front elevational view illustrating another alternative embodiment of a flexible coupling member comprising a single C-spring 46. The single C-spring is relatively wide as compared with the previously shown embodiments. The C-spring also includes a pair of channels 48, 50 that extend longitudinally along the outer surface thereof. In this embodiment, no horizontal support is necessary and the C-spring is coupled directly to the fixed-base portion, preferably by a rotatable coupling mechanism. The C-spring is preferably configured to be wide enough to minimize lateral movements of the seat portion. An embodiment using a single C-spring has fewer parts and is therefore more lightweight and easier to manufacture.

From the foregoing, it will be appreciated that the present invention is lightweight rocker mechanism that provides a smooth and predictable rocking motion over a wide range of body weights. A rocking chair employing the rocker mechanism may be easily transported from place to place and is versatile enough for use in an indoor or outdoor environment. Furthermore, the rocker mechanism is resistant to corrosion, is easy to manufacture and provides excellent strength and durability.

SCOPE OF THE INVENTION

The above presents a description of a preferred embodiment of a flexible coupling mechanism adapted for use with a rocking chair, and of the manner and process of making and using it, in such full, clear, concise and exact terms as to enable any person skilled in the art to which it pertains to make and use this flexible coupling mechanism. This flexible coupling mechanism is, however, susceptible to modifications and alternate constructions from that discussed above which are fully equivalent. Consequently, it is not the intention to limit this flexible coupling mechanism to the particular embodiments disclosed. On the contrary, the intention is to cover all modifications and alternate constructions coming within the spirit and scope of the flexible coupling mechanism as generally expressed by the following claims, which particularly point out and distinctly claim the subject matter of the flexible coupling mechanism and chair structure using the same.

What is claimed is:

1. A chair comprising a seat member, a base, and a coupling mechanism for coupling the seat member to the base, the coupling mechanism adapted for providing a smooth deflection when subjected to a load so as to facilitate a rocking motion of the seat member relative to the base, the coupling mechanism comprising:

at least two elongate members each having a substantially rectangular cross-section and first and second ends, each of said elongate members having an inner surface and an outer surface and each being formed with a channel extending longitudinally along said outer surface from the first end to the second end to create a thin center portion located between thicker side portions, each of said elongate members having an elongate, generally flat upper segment, an elongate, generally flat lower segment disposed generally below the upper segment, and a curved segment between the upper and lower segments, the curved segment curving at least 180 degrees and configured to flex when the first and second ends are moved relative to one another, the first ends of the elongate members being connected to the chair member, the second ends of the elongate members being connected to the base; and a horizontal support coupled to said seconds ends of said elongate members, the horizontal support also being connected to the base;

wherein said horizontal support has a pair of mount portions, each mount portion comprising a recess having a contoured surface adapted to complement said outer surfaces of said elongate members so that an elongate member complementarily fits transversely across the mount portion.

2. The chair of claim 1, further comprising a post extending downward from said horizontal support, said post adapted to be received by a cylindrical cavity for providing a swivel motion therebetween.

3. The chair of claim 1, wherein the mount portions are arranged on the horizontal support so that the elongate members are spaced from one another and generally parallel to one another, and wherein the outer surfaces of the elongate members engage the mount portions in a manner to resist relative movement in a direction generally transverse to the longitudinal axis of the elongate members.

4. The chair of claim 1, wherein the curved segment curves about a substantially constant radius of curvature.

5. The chair of claim 4, wherein each of the elongate members have substantially the same cross-sectional profile from the first end to the second end.

6. A method of manufacturing a flexible coupling mechanism configured to resist lateral movement comprising:

providing at least two generally flat, elongate spring members each having a first and second end and first and second generally opposing sides, a channel extending along the surface of the first side substantially from the first end to the second end, the channel having substantially the same depth from the first end to the second end;

bending each of the elongate members to create a substantially flat, elongate upper section, a substantially flat, elongate lower section, and a curved section between the upper and lower sections, the curved section being bent at least about 180°;

providing an elongate connector comprising a pair of spaced apart mount surfaces, each mount surface having a recess that is contoured so as to be complementary to the channel of the corresponding elongate member in a direction generally transverse to the elongate connector;

attaching the lower sections of each bent elongate member to the connector so that the bent elongate members are spaced apart from one another and the channel of each elongate member complementarily engages the corresponding mount surface.

7. The method of claim 6, wherein the elongate spring members have substantially the same cross-sectional profile along their entire length.

8. The method of claim 6, additionally comprising forming an elongate slot in the upper section of each of the bent elongate members, wherein the elongate slot is generally parallel to a longitudinal axis of the corresponding elongate member.

* * * * *